US011767724B2

(12) United States Patent
Calderoni

(10) Patent No.: US 11,767,724 B2
(45) Date of Patent: Sep. 26, 2023

(54) VALVE ELEMENT FOR DRILLING ELEMENTS, DRILLING ELEMENTS AND METHOD FOR ASSEMBLING THE VALVE ELEMENT TO DRILLING ELEMENTS

(71) Applicant: DRILLMEC S.P.A., Gariga di Podenzano (IT)

(72) Inventor: Angelo Calderoni, San Donato Milanese (IT)

(73) Assignee: DRILLMEC S.P.A., Gariga di Podenzano (IT)

( * ) Notice: Subject to any disclaimer, the term of this patent is extended or adjusted under 35 U.S.C. 154(b) by 0 days.

(21) Appl. No.: 17/782,563

(22) PCT Filed: Dec. 3, 2020

(86) PCT No.: PCT/IB2020/061422

§ 371 (c)(1),
(2) Date: Jun. 3, 2022

(87) PCT Pub. No.: WO2021/111347

PCT Pub. Date: Jun. 10, 2021

(65) Prior Publication Data

US 2023/0016734 A1 Jan. 19, 2023

(30) Foreign Application Priority Data

Dec. 4, 2019 (IT) ..... 102019000022971

(51) Int. Cl.
*E21B 21/10* (2006.01)
*E21B 33/00* (2006.01)

(52) U.S. Cl.
CPC ..... *E21B 21/106* (2013.01); *E21B 33/00* (2013.01); *E21B 2200/05* (2020.05)

(58) Field of Classification Search
CPC ..... E21B 21/106; E21B 33/00; E21B 2200/05
See application file for complete search history.

(56) References Cited

U.S. PATENT DOCUMENTS 1,491,986 A * 4/1924 Greene ..... E21B 21/106 137/605
3,298,385 A * 1/1967 Jackson ..... E21B 21/106 285/376

(Continued)

FOREIGN PATENT DOCUMENTS

WO 2014/203155 A1 12/2014
WO 2016/097967 A1 6/2016

OTHER PUBLICATIONS

International Search Report and Written Opinion for PCT/IB2020/061422 (dated Mar. 4, 2021).

(Continued)

*Primary Examiner* — James G Sayre
(74) *Attorney, Agent, or Firm* — Merchant & Gould P.C.

(57) ABSTRACT

A valve element selectively opens and closes a radial aperture and an axial hole in a drilling element for drilling mud circulation. The valve element includes a fixing portion allowing the valve element to sealingly fix to the drilling element at the radial aperture. A body has an inlet aperture and an outlet aperture, and a duct for putting the apertures in communication with each other, defining a path for the drilling mud. A plug selectively seals the inlet aperture. A first sealing element is positioned in a housing formed in the axial hole of the drilling element. A shutter pivoted to the body includes a second sealing element to selectively and sealingly close the outlet aperture. The shutter selectively and sealingly closes the axial hole by abutting against the first sealing element. The valve element is adapted to keep the outlet aperture of the body normally closed.

16 Claims, 11 Drawing Sheets

(56) References Cited

U.S. PATENT DOCUMENTS

| | | | | |
|---|---|---|---|---|
| 4,825,902 | A * | 5/1989 | Helms | E21B 21/10 137/515 |
| 9,909,391 | B2 * | 3/2018 | Girola | E21B 23/02 |
| 10,337,268 | B2 * | 7/2019 | Girola | E21B 19/16 |
| 2018/0363789 | A1 | 12/2018 | Nguyen | |

OTHER PUBLICATIONS

International Preliminary Report on Patentability for PCT/IB2020/061422 (dated Aug. 30, 2021).

* cited by examiner

VALVE ELEMENT FOR DRILLING ELEMENTS, DRILLING ELEMENTS AND METHOD FOR ASSEMBLING THE VALVE ELEMENT TO DRILLING ELEMENTS

This application is a National Stage Application of PCT/IB2020/061422 filed Dec. 3, 2020, which claims priority to Application No. 102019000022971, filed Dec. 4, 2019, in Italy, and which applications are incorporated herein by reference. To the extent appropriate, a claim of priority is made to each of the above disclosed applications.

BACKGROUND OF THE INVENTION

The present invention relates to a valve element for continuous circulation of the drilling mud in a well through a drilling rig. The present invention also relates to drilling elements, such as, for example, an element of a drill pipe, i.e. a box of a tool joint integrated with the drill pipe, or a coupling element, or sub, with which such valve element can be associated. Furthermore, the present invention relates to a method for assembling such valve element to said drilling elements.

SUMMARY OF THE INVENTION

Said valve element is adapted to be associated with a radial aperture in hydraulic communication with an axial hole or duct comprised in the drilling elements. The valve element according to the present invention comprises a single internal shutter, which is adapted to effect the selective and automatic closing of either the radial aperture or the axial hole of the drilling element with which said valve element may be associated.

It is known to those skilled in the art that drilling mud needs to be continuously made to circulate through a drill bit connected to the end of a string of drilling elements, at or near the well bottom, also when inserting or removing drill pipes, in order to prevent the uncovered borehole from suffering damage. Mud circulation through the drill bit while inserting or removing pipes occurs thanks to a drilling element that, besides comprising a through hole running along the longitudinal axis, also comprises a radial aperture adapted to allow drilling mud to enter when mud can no longer be pumped directly through the axial hole and the top drive. This need is particularly felt when drilling critical wells, e.g. when drilling deep wells, high-pressure and/or high-temperature wells, deviated or horizontal wells, extended reach wells and deep and ultra deep water wells. In such cases, in fact, it is necessary to keep the well bottom pressure at appropriate constant levels to increase the safety and performance levels of the drilling rig.

Several drilling elements, in particular SUBS, are known in the prior art which comprise a single valve capable of selectively closing either the axial aperture or the radial aperture.

A device is known from patent application WO2014203155 for ensuring continuous circulation in well drilling, which comprises a tubular body having an axial channel therein, with a lateral opening closed by a removable plug. A FLAP valve is placed in the tubular conduit, whose shut-off member is movable between a transverse position, in which it closes said axial channel, and a longitudinal position, in which it closes said lateral opening in a pressure-tight manner. Said device comprises a magnetic means adapted to operate on said shut-off member in said longitudinal position and retain said shut-off member in said longitudinal position with a preset load, and as the latter is applied said shut-off member may be moved to said transverse position.

A device is also known from prior document WO2016097967A1 for ensuring continuous circulation in well drilling which comprises a tubular body having an axial channel therein, with a lateral opening closed by a removable plug. A tubular support is placed in the axial conduit, and supports a shut-off member which is held in position by retainer means. The device comprises an adjustment ring nut which exerts a pressing action between said retainer means and said tubular support to force said tubular support in an axial limit-stop position against respective positioning and centering means, to thereby allow recovery of clearances during placement of said tubular support and the valve means supported thereby inside the tubular body.

The solutions currently known in the art are not efficient, in that the valve element is essentially an additional element, e.g. a sub, which must be screwed to a drilling element, and therefore represents an element of discontinuity subject to continuous stresses during the drilling, resulting in deterioration and poor reliability.

Furthermore, since the valve element is associated with a SUB, the systems for continuous mud circulation known in the art suffer from non-negligible load losses under the action of the mud flow while drilling the well, because of the increased length of the small-diameter conduit; as a matter of fact, the inside diameter of a sub, which is similar to that of the tool joint, is much smaller than the inside diameter of the pipe, and this leads to pressure problems.

Moreover, the solutions currently known in the art require a complex procedure for assembling said valve element to the drilling element; for this reason, they can only be applied to a SUB to be screwed and unscrewed in proximity to the tool joints of the drill pipes. Such a SUB screwed to the tool joint of the drill pipe represents a point of discontinuity and a weak point along the drill string.

Furthermore, the large number of parts that need to be assembled in order to obtain a valve element increases the risk of malfunctions and/or failures, in addition to reducing the number of guaranteed service hours without any failures due to deterioration.

What is more, such solutions require a considerable reduction of the cross-section of the axial hole of the drilling element or a significant deviation of the path thereof, thus creating considerable load losses, in addition to making such valve elements more subject to wear and potential malfunctions.

In addition, according to prior solutions, in case of a faulty valve element maintenance must be carried out from above and requires the drilling element associated with the malfunctioning valve element to be removed from the string, thus increasing the downtime of the drilling rig.

The present invention aims at solving the above-mentioned technical problems by providing a valve element adapted for selectively and automatically opening and closing both a radial aperture and an axial hole of a drilling element under service pressures up to 10,000 psi, thereby obtaining a very reliable device which is less prone to failures or malfunctions, and which can be easily assembled to a drilling element without affecting the dimensions of the axial hole, or which may even be included in the drill string, resulting in a further decrease of the load losses and fewer points of discontinuity in the drill string, thus making the system very reliable.

One aspect of the present invention relates to a valve element having the features set out in the appended claim 1.

A further aspect of the present invention relates to a drilling element having the features set out in the appended claim 10.

A further aspect of the present invention relates to a method for assembling a valve element to a drilling element according to claim 13.

Optional features of the valve element, drilling element and method are set out in respective dependent claims.

BRIEF DESCRIPTION OF THE DRAWINGS

The features and advantages of the valve element, drilling element and method will become apparent from the following illustrative and non-limiting description of several possible embodiments thereof, as well as from the annexed drawings, wherein.

Figure 1:
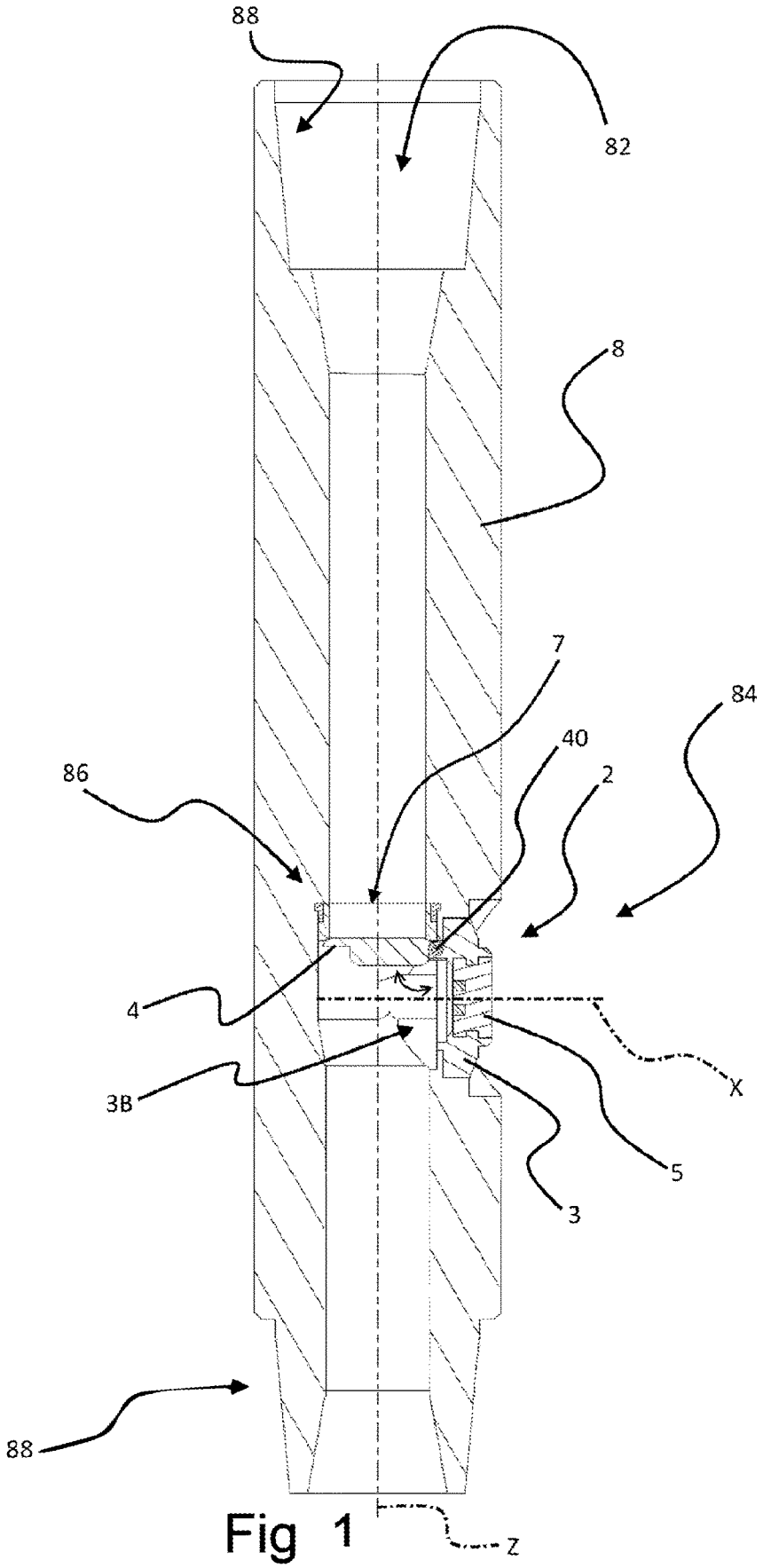
FIG. 1 shows a sectional view relative to a vertical plane of one possible embodiment of a valve element assembled to a drilling element, e.g. a sub, so as to constitute an exemplary, but non-limiting, assembly, wherein the valve element is in an open configuration.

With reference to the above-mentioned figures, reference numeral 2 designates the valve element as a whole. Reference numeral 8 designates, as a whole, a drilling element according to the present invention.

Figure 6:
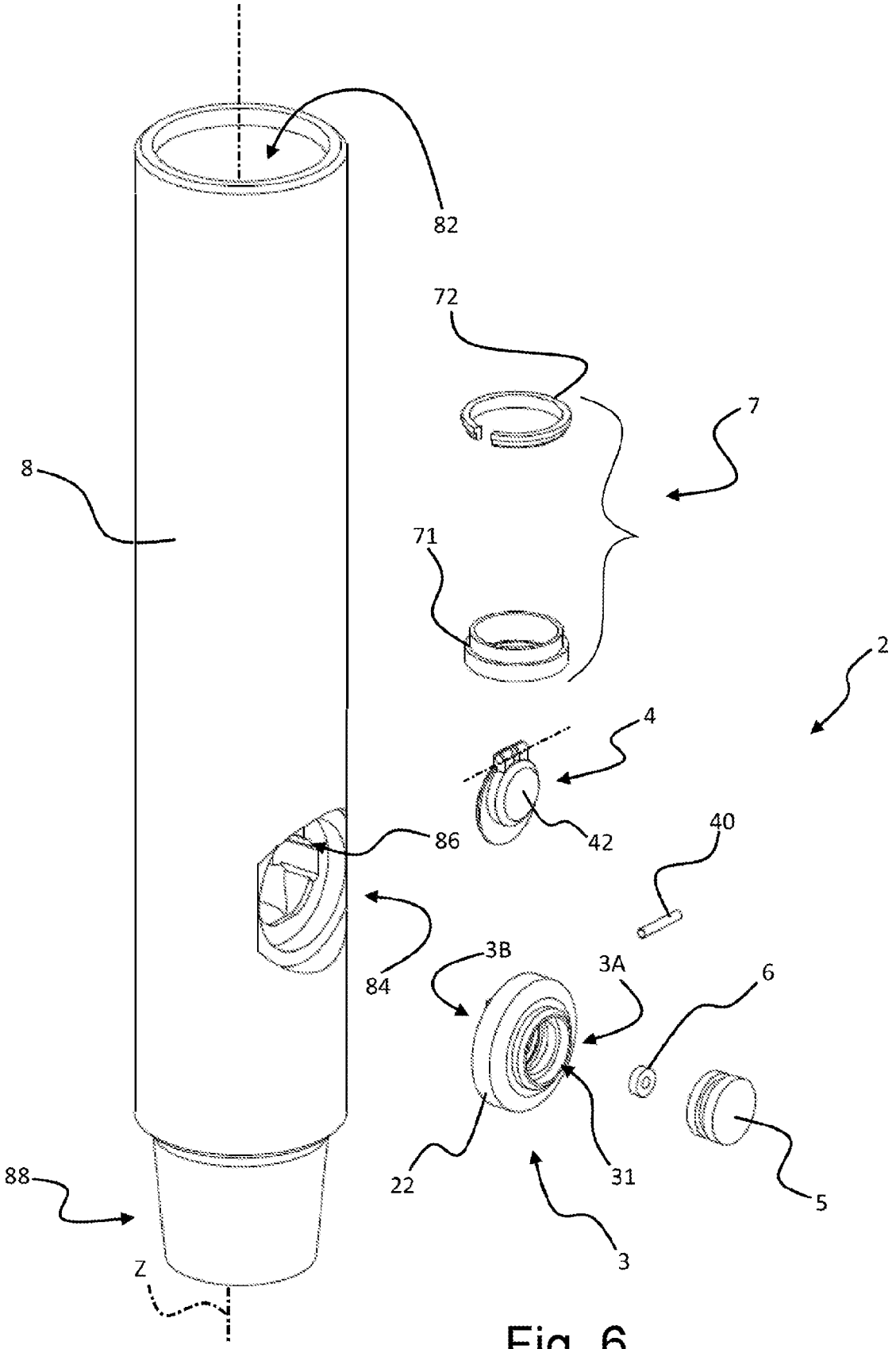
FIG. 6 shows an exploded axonometric view of the assembly made up of the valve element and the drilling element shown in FIG. 1.
Figure 8:
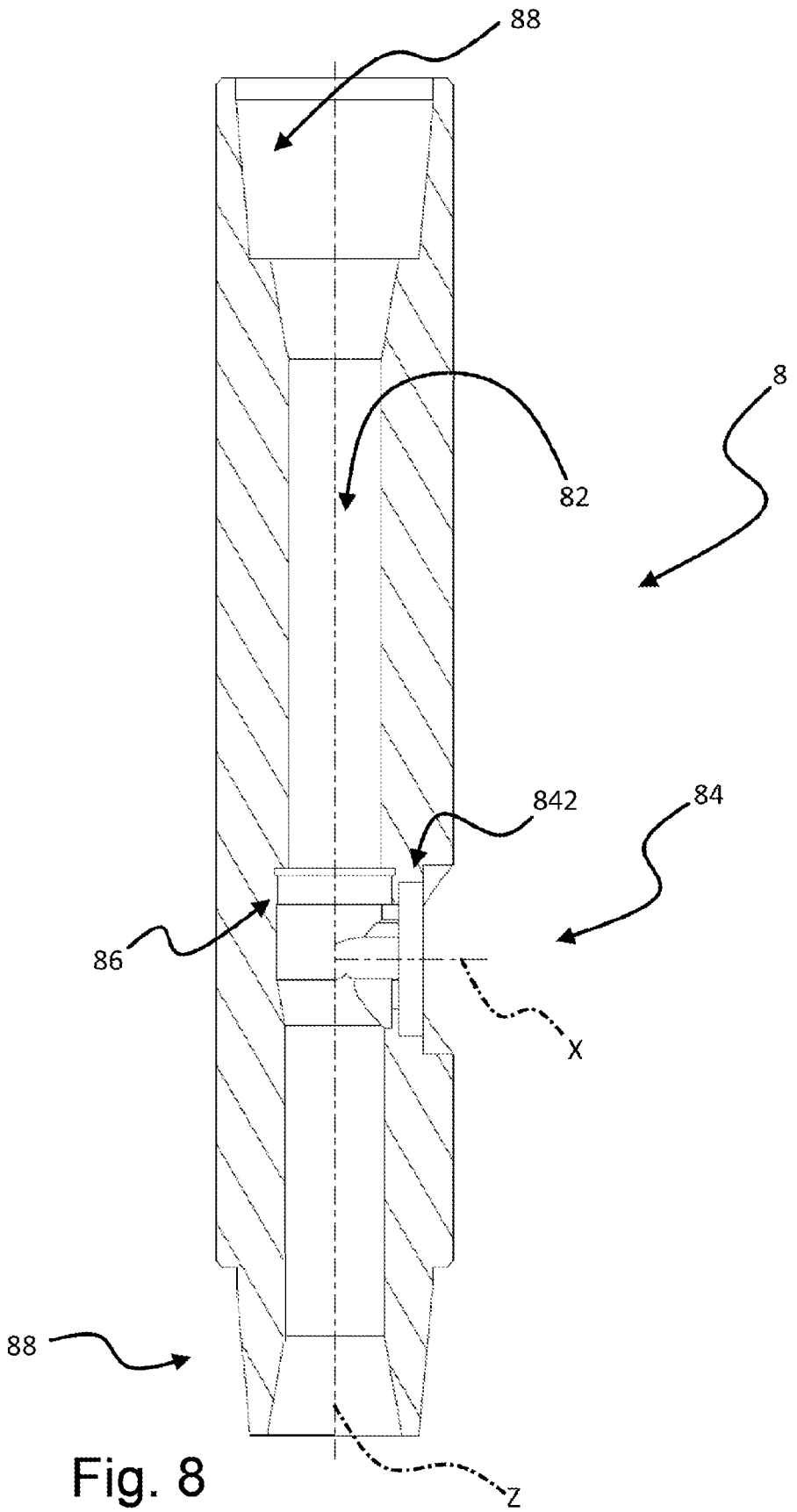
FIG. 8 shows a drilling element in a sectional view relative to a vertical plane.

For the purposes of the present invention, the term drilling element 8 refers to any device having a substantially cylindrical shape which is used for drilling an extraction well, which can be inserted into the well, and which comprises an axial hole 82 and a radial aperture 84, as shown by way of example in FIGS. 6 and 8.

Valve element 2 according to the present invention is particularly adapted for selectively opening and closing both a radial aperture 84 and an axial hole 82 comprised in a drilling element 8 for drilling mud circulation.

Valve element 2 according to the present invention comprises: a fixing portion 22 adapted to allow valve element 2 to be sealingly fixed to drilling element 8 at said radial aperture 84, preferably to the walls that define said radial aperture 84, even more preferably to the walls of the hole that defines said radial aperture 84.

Valve element 2 according to the present invention further comprises a body 3. Said body 3 comprises an inlet aperture 3A, an outlet aperture 3B, and a duct 31, which is adapted to put such apertures (3A, 3B) in communication with each other, thereby defining a path for the drilling mud.

Valve element 2 according to the present invention further comprises a plug 5. Said plug 5 is adapted to selectively seal said inlet aperture 3A of body 3.

In a preferred, but merely explanatory and non-limiting, embodiment, plug 5 is adapted to be fixed to said body 3 to seal said inlet aperture 3A.

Valve element 2 according to the present invention further comprises a first sealing element 7. Said first sealing element 7 is adapted to be positioned in a housing 86 formed in axial hole 82 of drilling element 8.

Valve element 2 according to the present invention further comprises a shutter 4, preferably only one per each valve element 2. Said shutter 4 is movably connected, preferably pivoted, to body 3.

Preferably, said shutter 4 comprises a second sealing element 42. Through said second sealing element 42, shutter 4 is adapted to selectively and sealingly close said outlet aperture 3B of body 3.

Said second sealing element 42 is, for example, a gasket or an equivalent element. In a preferred embodiment, said second sealing element 42 is fixed to said shutter 4, preferably in a removable manner. In an alternative embodiment, said second sealing element 42 is appropriately fixed to outlet aperture 3B.

More in general, said second sealing element 42 is suitably shaped to ensure tightness when said shutter 4 is in abutment with said outlet aperture 3B of body 3.

Shutter 4 is adapted to selectively and sealingly close said axial hole 82 by abutting against said first sealing element 7.

Valve element 2 according to the present invention is therefore adapted to selectively close either a radial aperture 84 or an axial hole 82 by means of a single shutter 4.

Preferably, valve element 2 according to the present invention is designed in a manner such that said shutter 4 is adapted to keep said outlet aperture 3B of body 3 normally closed. In particular, the present embodiment of valve element 2, once assembled to said drilling element 8, permits keeping said radial aperture 84 normally closed while keeping said axial hole 82 normally open.

For the purposes of the present description, the expression "to sealingly close" means to close in a pressure-tight manner.

In a preferred embodiment of drilling element 8, said axial hole 82 extends along a longitudinal axis "Z" of drilling element 8, whereas said radial aperture 84 extends along a first axis "X", which is perpendicular to said longitudinal axis "Z".

In a preferred embodiment of valve element 2 according to the present invention, said body 3 defines an outer portion, e.g. a perimetric outer portion, whereon said fixing portion 22 is formed. In this embodiment, said body 3 does not protrude past the walls of said drilling element 8, preferably with reference to both the outer walls and the inner walls that define such axial hole 82. The present embodiment permits incorporating said body 3 into the structure of drilling element 8, and in particular into the hole that defines said radial aperture 84. Said body 3 does not project out of the hole that defines said radial aperture 84, as shown by way of example in FIGS. 1, 2, 5.

In a preferred embodiment of valve element 2 according to the present invention, said body 3 has a substantially discoid shape. Such an embodiment permits incorporating said body 3 into said radial aperture 84. Preferably, in the perimetric outer edge of body 3 said fixing portion 22 is formed as a threaded or shape-coupling portion adapted to sealingly match a threaded or shape-coupling portion 842 formed in the walls of the hole that defines said radial aperture 84. Optionally, in order to ensure pressure tightness between body 3 and radial aperture 84, sealing elements may be comprised, e.g. gaskets. In particular, in this embodiment said radial aperture 84 is defined by a substantially circular hole. In general, the present solution permits making double-headed threaded portions even far from the ends of drilling elements 8.

In the preferred embodiment of valve element 2 according to the present invention, said plug 5 is adapted to be directly fixed to body 3 for the purpose of sealing said inlet aperture 3A.

In one possible embodiment of valve element 2, said plug 5 is fully removable from said body 3. In such an embodiment there are no elements adapted to bind said plug 5 to body 3 when the plug is removed.

Preferably, plug 5 is automatically removable, e.g. by means of automated actuators known to a person skilled in the art, which can safely remove said plug 5.

More in general, the use of a plug 5 in valve element 2 makes it possible to increase the maximum working pressure of the drilling rig.

Said body 3 and said plug 5 are designed with an optimized external geometry that makes plug 5 easily engageable by said automated actuators, e.g. a clamp.

Said inlet aperture 3A preferably comprises a threaded or shape-coupling portion adapted to be sealingly coupled to a matching threaded or shape-coupling portion formed on said plug 5 to provide a tight closure. Said threaded or shape-coupling portions may be formed by means of suitable threads or shape couplings, e.g. of the bayonet type. Optionally, in order to ensure pressure tightness, sealing elements are comprised between said body 3 and said plug 5, e.g. gaskets.

The flow of drilling mud that is injected through said radial aperture 84 after removal of plug 5 enters said inlet aperture 3A of body 3 and proceeds in said duct 31, which is preferably straight, until it arrives at said outlet aperture 3B.

In general, said outlet aperture 3B is selectively closed by said shutter 4 to prevent mud to flow towards the inside of a drilling element 8, and vice versa.

In a preferred embodiment of valve element 2 according to the present invention, it is so designed that said shutter 4 is adapted to keep said outlet aperture 3B of body 3 normally closed. In one possible embodiment, said shutter 4 comprises at least one ferromagnetic portion. Said valve element 2 comprises return means 6 adapted to hold said shutter 4 in the desired position, said return means being also adapted to prevent valve element 2, and in particular shutter 4, from being affected by the vibration of the drill string during the drilling process. Preferably, said return means 6 are of the magnetic and/or mechanical type and are adapted to keep said shutter 4 in sealed abutment with said outlet aperture 3B of body 3. Said magnetic return means 6 act upon said ferromagnetic portion of shutter 4 by attracting it.

In general, said return means 6 may be associated with said body 3 and/or said plug 5, being preferably fixed to, preferably incorporated into, the structure of plug 5.

In general, said return means 6 are such as to keep said shutter 4 closed against said outlet aperture 3B under a load pressure. Shutter 4 can move from such position when a load pressure is exerted on shutter 4 itself, and in particular when a predetermined pressure threshold is exceeded. Therefore, when the flow of drilling mud exceeds a predetermined pressure, shutter 4 will move and open said outlet aperture 3B.

More in general, said valve element 2 gets into a closed configuration when said shutter 4 is sealingly closing said outlet aperture 3B, closing as a result the radial aperture 84 with which body 3 of valve element 2 is associated. On the contrary, said valve element 2 gets into an open configuration when said shutter 4 is in abutment with said first sealing element 7, thus sealingly closing said axial hole 82 of drilling element 8 with which said valve element 2 is associated.

In a preferred, but non-limiting, embodiment of valve element 2 according to the present invention, said first sealing element 7 comprises: a gasket 71 and an elastic means 72. Said gasket 71 is adapted to abut on said shutter 4 for the purpose of sealingly closing said axial hole 82. Said elastic means 72 is adapted to keep said gasket 71 in position within said housing 86, in particular in any configuration of valve element 2 and/or any direction of flow of the drilling mud.

Preferably, said gasket 71 has an annular shape suitably capable of interacting with said housing 86 of drilling element 8 and with elastic means 72. Said elastic means 72 also has an annular shape, preferably with open ends, so that its diameter can be varied to appropriately match housing 86 formed in axial hole 82.

Said shutter 4 can sealingly close said axial hole 82, thereby preventing the flow of drilling mud, by abutting against said first sealing element 7. In particular, said shutter 4, by abutting against said first sealing element 7, prevents the drilling mud from flowing in a direction opposite the one towards the bottom of the extraction well.

The holding of shutter 4 in position, so as to sealingly close said axial hole 82, is ensured, for example, by the pressure under which the drilling mud is injected into drilling element 8 through said radial aperture 84, as opposed to from above along said axial hole 82.

More in general, said valve element 2 is designed in a manner such that, when applied to a drilling element 8, the pressure difference between axial hole 82 and radial aperture 84 will allow said shutter 4 to move in order to selectively and sealingly close either said axial aperture 82 or said radial aperture 84. In particular, when the pressure of the mud entering through said inlet aperture 3A exceeds a predetermined pressure, said shutter 4 will open said outlet aperture 3B, thereby opening said radial aperture 84, and said shutter 4 will sealingly abut against said first sealing element 7, thereby closing said axial hole 82 of drilling element 8.

In a preferred embodiment, said shutter 4 is a flap valve. Said flap valve is univocal in a valve element 2 according to the present invention.

In a preferred, but non-limiting, embodiment of valve element 2 according to the present invention, said shutter rotates about an axis of rotation "Y". Said axis of rotation "Y" is perpendicular to said first axis "X", along which said duct 31 of body 3 extends, i.e. the axis along which said radial aperture 84 extends. Said axis of rotation "Y" is also perpendicular to the longitudinal axis "Z" of axial hole 82 of drilling element 8.

The present embodiment permits reducing the risk of vibrations and/or failures during the drilling, thus extending the service life of shutter 4 and hence that of valve element 2 according to the present invention.

Preferably, said shutter 4 is hinged to body 3 by means of a pin 40, being able to rotate about the axis of said pin 40 that defines said axis of rotation "Y".

Preferably, said shutter 4 has a substantially discoid shape suitable for abutting against said first sealing element 7 and said outlet aperture 3B, respectively, and ensure tight closures.

Valve element 2 according to the present invention is particularly suited to be associated, e.g. thus forming an assembly, with a drilling element 8. Said drilling element has a substantially cylindrical shape. Said drilling element 8 in turn comprises: an axial hole 82; at least one radial aperture 84 and junction portions 88.

Said axial hole 82 substantially extends along a longitudinal axis "Z" of drilling element 8 and is in fluidic communication with said radial aperture 84, which extends along a first axis "X" perpendicular to said longitudinal axis "Z".

Said junction portions 88 are located at the ends of drilling element 8, so that said drilling element 8 can be connected to other drilling elements 8 in order to form the string of drilling elements.

A valve element 2 according to the present invention is associated with radial aperture 84 of drilling element 8. In one possible embodiment of drilling element 8 according to the present invention, said radial aperture 84 is located in a central region of drilling element 8, i.e. distant from said junction portions 88, with reference to the longitudinal extension. Alternatively, depending on the type of drilling element 8, said radial aperture 84 is located in proximity to one end, with reference to the longitudinal extension, proximal to said junction portions 88, e.g. near an element of a drill pipe, or box of a tool joint integrated into the drill pipe.

Some possible embodiments of said drilling element 8 envisage that it may be: a junction portion, or box, of a drill pipe; or a coupling element, or sub.

Preferably, said radial aperture 84 comprises a threaded or shape-coupling portion 842 to which a valve element 2 according to the present invention, provided with a matching fixing portion 22, can be sealingly connected 2. Even more preferably, said threaded or shape-coupling portion 842 is located in the walls of the hole that defines said radial aperture 84, so that said valve element 2 can be received within the very structure of drilling element 8. In such an embodiment, said valve element 2 does not protrude from the outer perimeter of drilling element 8.

Preferably, when said valve element 2 is associated with radial aperture 84 of a drilling element 8 and is in a closed configuration, said shutter 4 does not protrude past a minimum diameter of said axial hole 82.

Said axial hole 82 comprises at least one housing 86 adapted to receive said first sealing element 7. Said housing 86 is preferably at least one undercut portion formed in axial hole 82, which increases the diameter of the latter. Preferably, said housing 86 is located in proximity to said radial aperture 84.

In a preferred embodiment, said housing 86 has a first undercut portion, adapted to receive said elastic means 72 of the first sealing element 7, and a second undercut portion, where said elastic means 72 interacts with said gasket 71, holding it in position within said housing 86.

Preferably, axial hole 82 comprises after said housing 86, along its longitudinal extension, a suitably shaped portion that allows said shutter 4 to move between the two positions, in which it selectively closes said axial hole 82 and said radial aperture 84, thus defining said open and closed configurations of valve element 2. Past such suitably shaped portion along the longitudinal extension, axial hole 82 returns to its predetermined diameter, in particular a minimum diameter.

Preferably, said axial hole 82 has a minimum diameter of 2"¾ or 70.1 mm along its whole longitudinal extension. Even more preferably, said axial hole 82 has no curvatures relative to the longitudinal axis "Z" and/or no portions narrower than the desired minimum value of 2"¾ or 70.1 mm.

Figure 9:
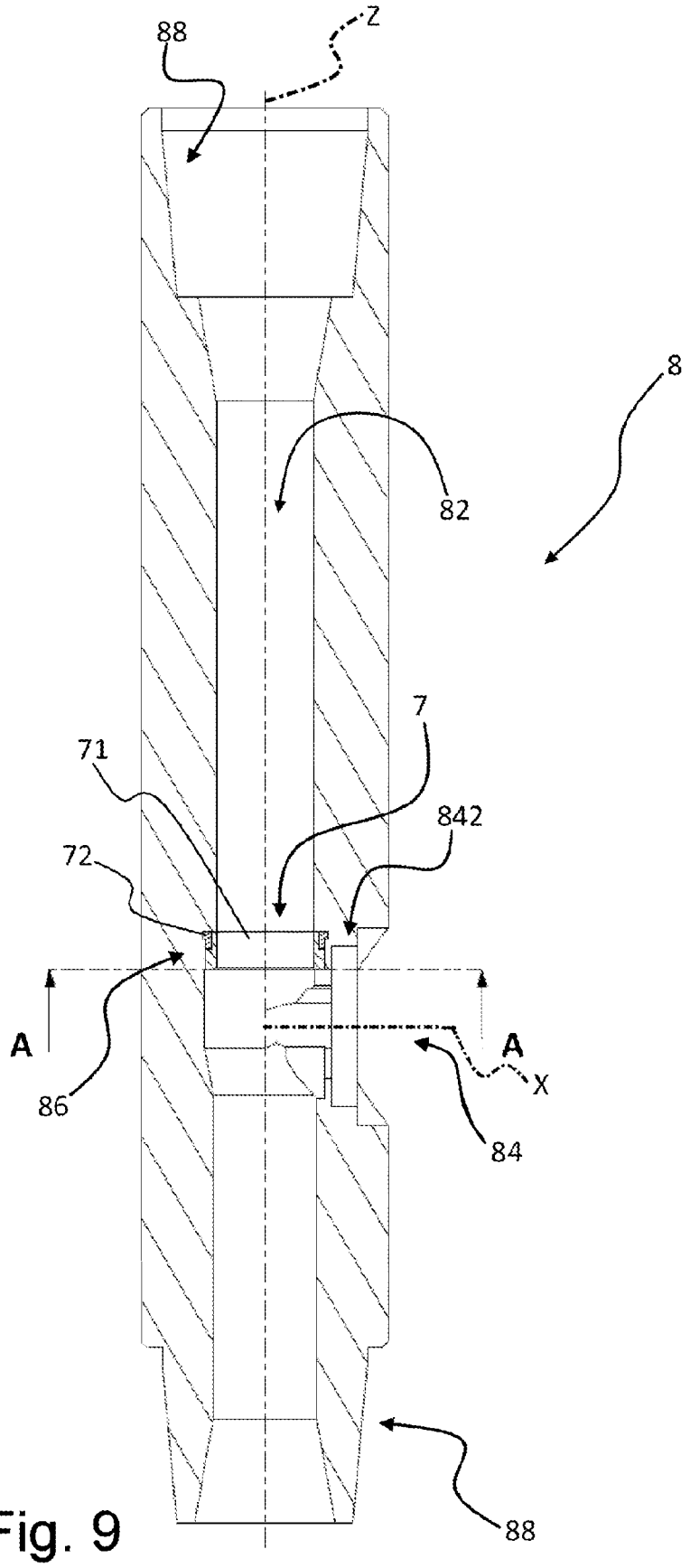
FIG. 9 shows a first step of the method for assembling the assembly according to the present invention, wherein a first sealing element is properly positioned into a suitable housing in the axial hole of the drilling element.
Figure 10:
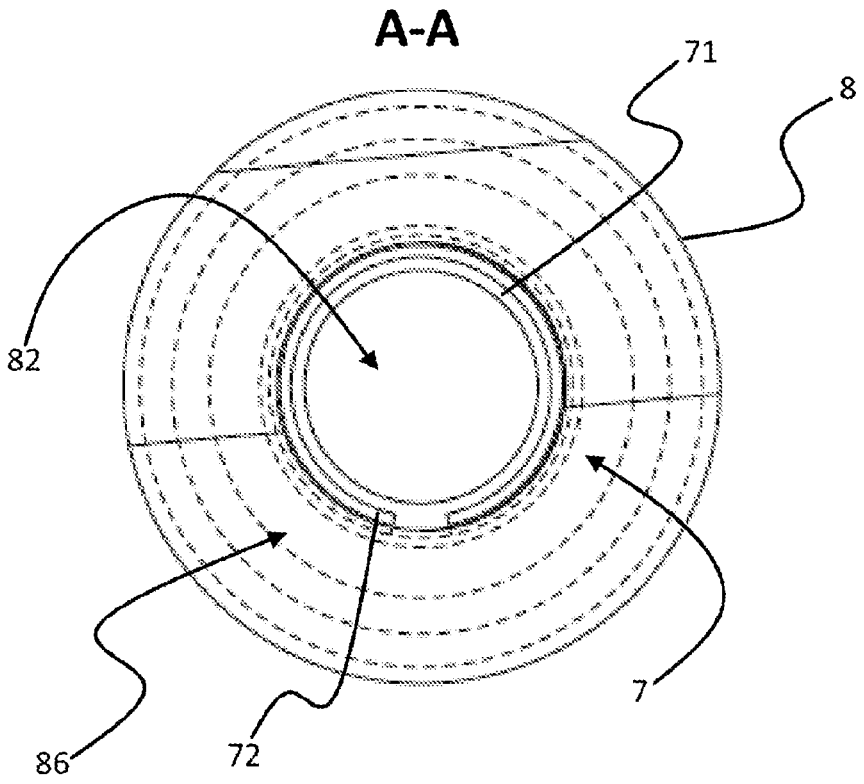
FIG. 10 shows a sectional view relative to a horizontal plane A-A of the portion of the assembly shown in FIG. 9.

Said first sealing element 7 is designed in a manner such that said gasket 71 and said elastic means 72, once assembled within the housing 86, have a minimum diameter of 2"¾ or 70.1 mm. In the present embodiment, once valve element 2 has been assembled to drilling element 8, the minimum diameter of the duct along which the drilling mud flows along the longitudinal axis "Z" is not smaller than 2"¾ or 70.1 mm. It is thus possible to avoid any load losses in the pressure of the drilling mud, thereby improving the performance of the drilling rig. This aspect is best illustrated in FIGS. 9 and 10, which show that there are no portions narrower than the diameter of axial hole 82, thus ensuring the desired minimum diameter of the duct along which the drilling mud will have to flow.

Drilling element 8 and valve element 2 are adapted to be assembled together for the purpose of forming an assembly. For example, one possible method for assembling a valve element 2 according to the present invention to a drilling element 8 according to the present invention comprises the following steps, preferably carried out in succession:

- providing at least one valve element 2 and at least one drilling element 8;
- associating a first sealing element 7 with a housing 86 formed in an axial hole 82 of drilling element 8;
- fixing a body 3 to a radial aperture 84 of drilling element 8.

The step of providing at least one valve element 2 and at least one drilling element 8 consists of manufacturing a valve element 2 and a drilling element 8 in accordance with the present invention.

In a preferred, but merely illustrative and non-limiting, embodiment of the method according to the present invention, the step of associating a first sealing element 7 is carried out by passing said sealing element 7 through radial aperture 84 of drilling element 8. The present method permits assembling valve element 2 to a drilling element 8 even when said radial aperture 84 is distant from the ends of drilling element 8, e.g. distant from both junction portions 88, e.g. in a central region of the drilling element.

FIG. 9 shows a first step of the method for assembling the assembly according to the present invention, wherein the first sealing element 7 has been appropriately positioned in a suitable housing 86 formed in axial hole 82 of drilling element 8. From this figure one can easily understand that said first sealing element 7 can be made to pass through said radial aperture 84 and positioned in housing 86, e.g. by first inserting said elastic means 72 by suitably deforming it so that it can pass through said radial aperture 84 and then positioning it in the dedicated undercut portion of housing 86. Subsequently it is possible to insert said gasket 71 through said radial aperture 84, positioning it correctly in housing 86.

FIG. 10 shows a sectional view relative to a horizontal plane A-A of the partially assembled portion of the assembly shown in FIG. 9, wherein one can see that said first sealing element 7 does not protrude past said housing 86, thus not causing axial hole 82 to become narrower. From this figure one can better understand the relative positions of gasket 71 and elastic means 72 of the first sealing element 7 within housing 86.

In one possible embodiment of the method according to the present invention, the step of fixing a body 3 to a radial aperture 84 is carried out by causing said body 3 to make at least one rotational movement, e.g. by screwing it, into the hole that defines said radial aperture 84. In fact, depending on the fixing means employed, said body 3 may be either screwed into said radial aperture 84 or coupled thereto by shape coupling, e.g. through a bayonet joint, as previously specified.

Preferably, during the execution of the step of fixing a body 3 to a radial aperture 84, said shutter 4 and said plug 5 are, respectively, already appropriately fixed to said body 3. Alternatively, the method according to the present invention may comprise a further step wherein a plug 5 is fixed to body 3. This latter step may be carried out either automatically, through suitable manipulators, or manually.

More in general, the assembling method according to the present invention may be carried out automatically, by actuating suitable automated devices, and/or manually.

Describing now more in detail the construction of a preferred, but non-limiting, embodiment, FIG. 1 shows a valve element 2 assembled to a drilling element 8 in a sectional view relative to a vertical plane, wherein valve element 2 is in an open configuration. In particular, it is possible to see body 3, with which plug 5 is associated, positioned in radial aperture 84 of drilling element 8. In this figure one can also see shutter 4 abutting against the first sealing element 7 positioned in housing 86. Said shutter 4 is hinged to body 3 through a suitable pin 40, about which it rotates in order to selectively close either axial hole 82 of drilling element 8 or outlet aperture 3B of body 3.

As an example, FIG. 1 shows a SUB, the longitudinal extension of which is shorter than that of a drill pipe. Besides, said valve element 2 is positioned in a central region along the longitudinal extension of drilling element 8, distant from junction portions 88.

Figure 11:
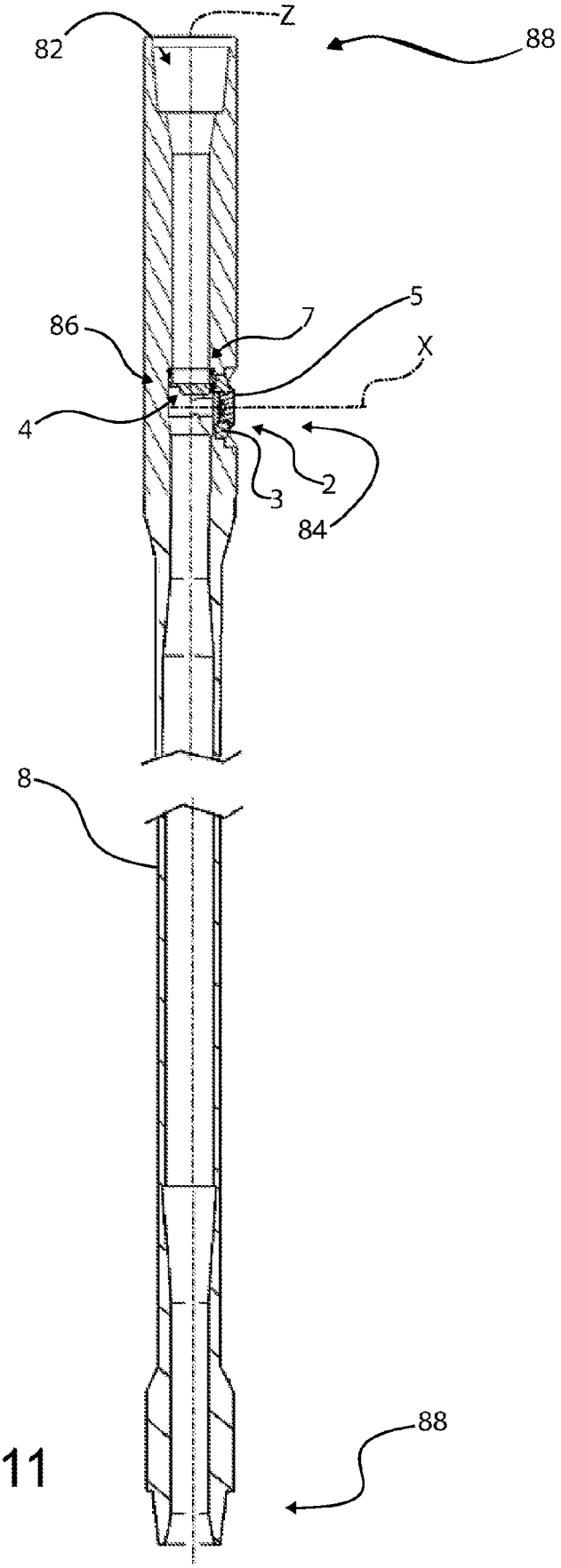
FIG. 11 shows the valve element assembled in the box of the tool joint of a drill pipe.

A drill pipe comprising valve element 2 according to the present invention is illustrated by way of example in FIG. 11.

FIG. 11, just like FIG. 1, shows a valve element 2 assembled to a drilling element 8 in a sectional view relative to a vertical plane, wherein valve element 2 is in an open configuration. In particular, in FIG. 11 it is possible to see body 3, with which plug 5 is associated, positioned in radial aperture 84 of drilling element 8. In this figure one can also see shutter 4 abutting against the first sealing element 7 positioned in housing 86. Said shutter 4 is hinged to body 3 through a suitable pin 40, about which it rotates in order to selectively close either axial hole 82 of drilling element 8 or outlet aperture 3B of body 3.

In the embodiment illustrated in FIG. 11, said valve element 2 is positioned near one end of drilling element 8 along the longitudinal extension of drilling element 8, in proximity to a junction portion 88; said valve element 2 being positioned, for example, near the box of the tool joint of the drill pipe.

Figure 2:
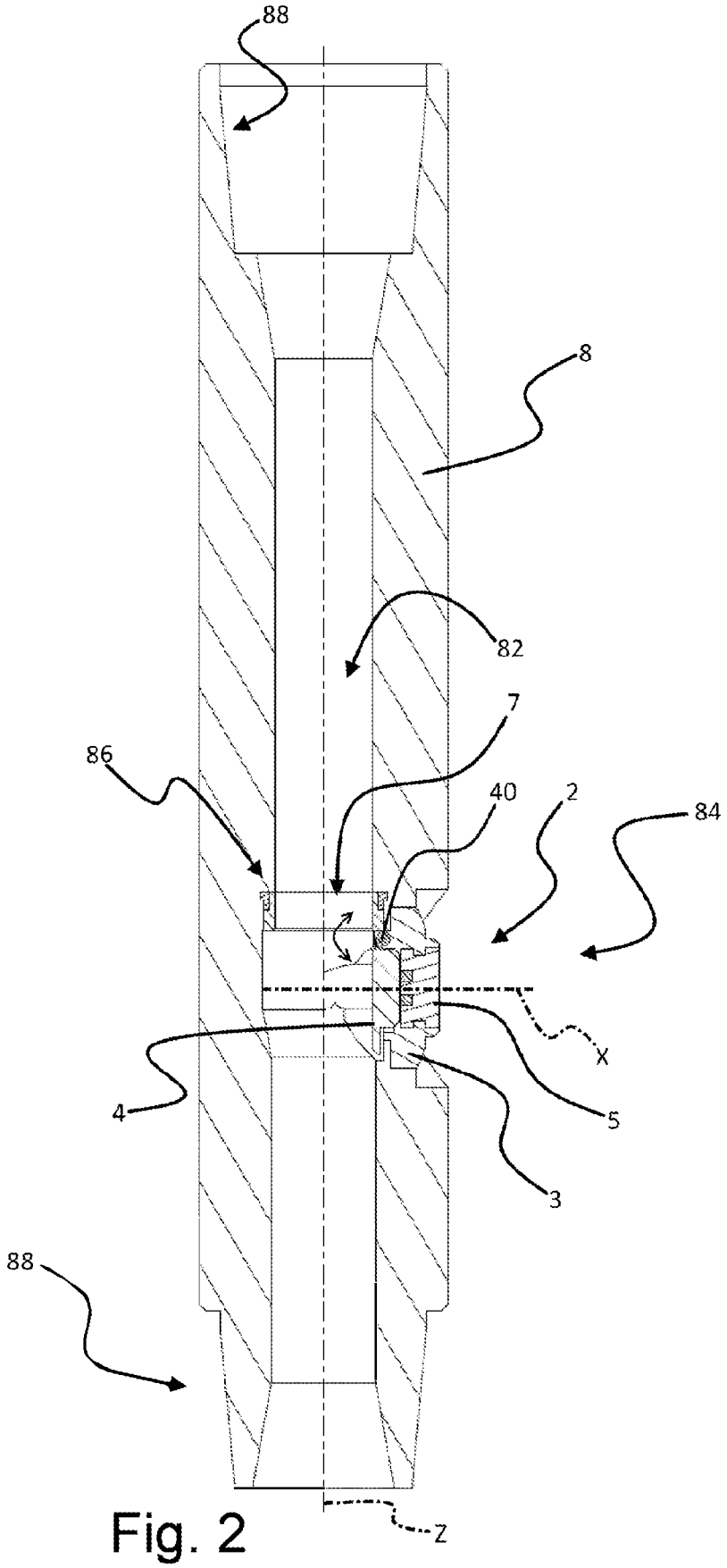
FIG. 2 shows a sectional view relative to a vertical plane of the assembly made up of the valve element and the drilling element shown in FIG. 1, wherein the valve element is in a closed configuration.

FIG. 2 shows the assembly made up of valve element 2 and drilling element 8 of FIG. 1, wherein valve element 2 is in a closed configuration. In this figure one can see that shutter 4 is no longer abutting against said first sealing element 7, thus opening said axial hole 82 of drilling element 8. Instead, said shutter 4 is closing said outlet aperture of body 3.

The drawings clearly show that shutter 4 is hinged to body 3 at a point such that the junction portion between body 3 and shutter 4 does not protrude past the minimum diameter of uaxial hole 82.

By comparing FIG. 1 with FIG. 2 it is possible to comprehend how said shutter 4 interacts with body 3 and the first sealing element 7 for selectively closing said axial hole 82 and/or said radial aperture 84. It is understood that, when drilling mud needs to be injected through said radial aperture 84, said plug 5 will have to be removed from said body 3.

Figure 3:
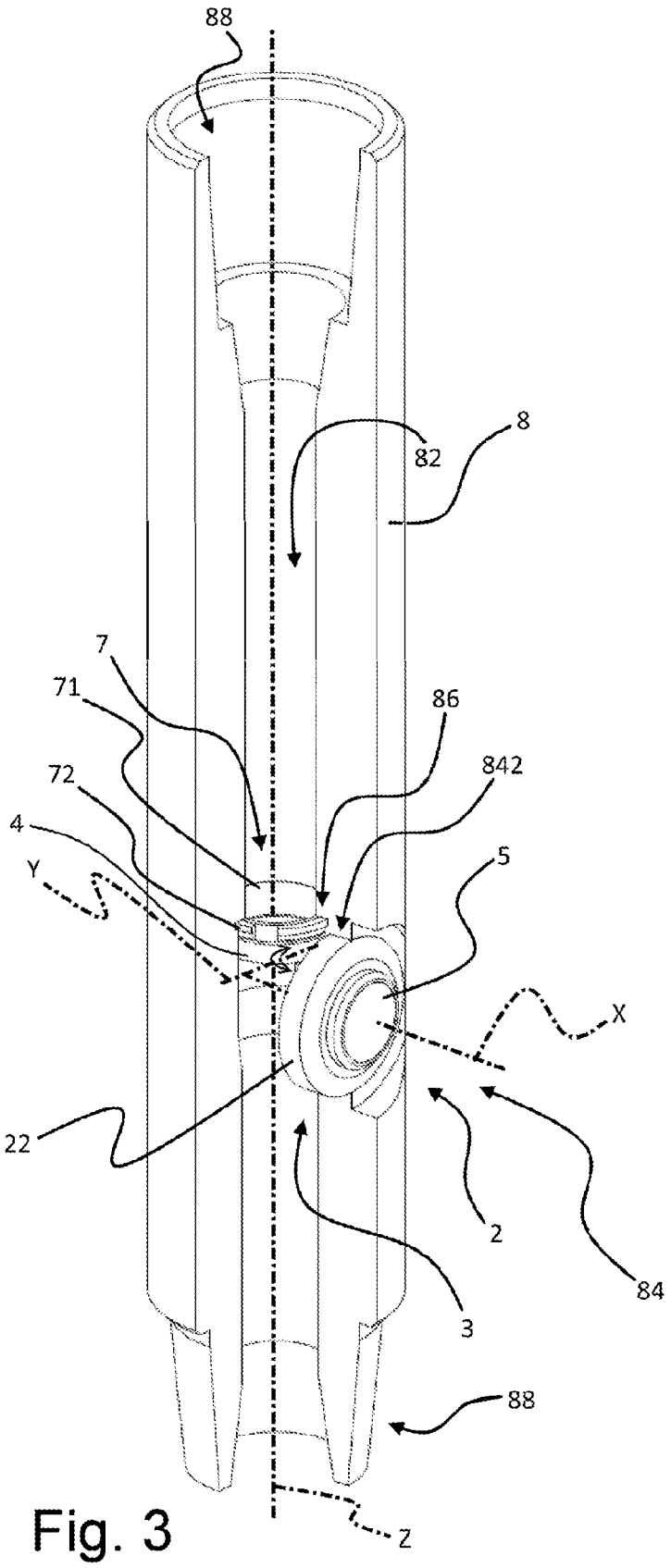
FIG. 3 shows a sectional axonometric view relative to vertical planes of the assembly made up of the valve element and the drilling element shown in FIG. 1, wherein the valve element is in an open configuration.

FIG. 3 shows a sectional axonometric view relative to vertical planes of the assembly made up of valve element 2 and drilling element 8. In this figure one can see valve element 2 in an open configuration, and one can easily understand the discoid conformation of both body 3 and shutter 4, the latter abutting against the first sealing element 7, which has an annular shape. In this figure one can easily identify gasket 71 and elastic element 72 comprised in the first sealing element 7. From this figure it is also possible to comprehend how fixing portion 22 can be positioned on the outer perimeter of body 3, so that it can interact with said threaded or shape-coupling portion 842 formed in the walls that define said radial aperture 84.

Figure 4:
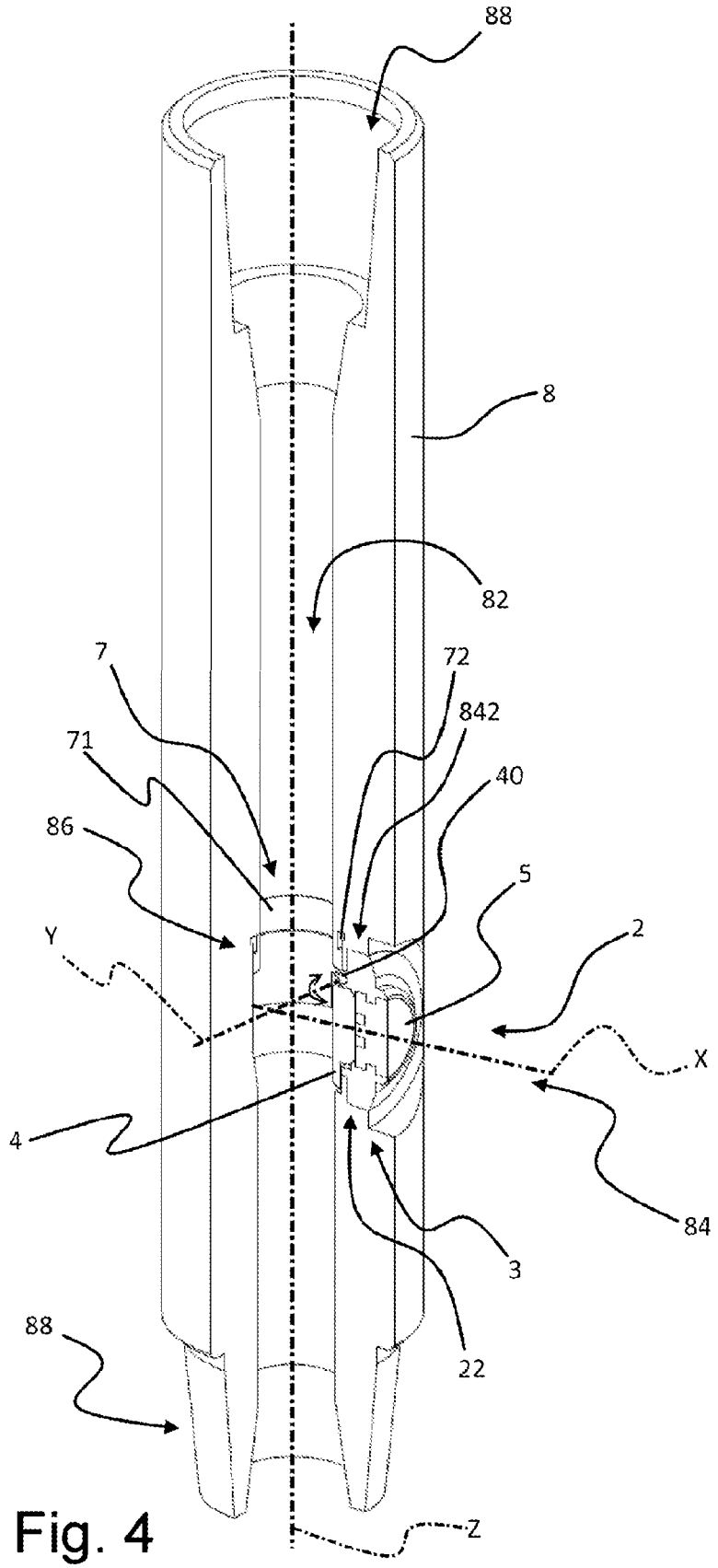
FIG. 4 shows a sectional axonometric view relative to vertical planes of the assembly made up of the valve element and the drilling element shown in FIG. 1, wherein the valve element is in a closed configuration.

FIG. 4 shows a vertical sectional view of the assembly made up of valve element 2 and drilling element 8, wherein the same valve element 2 is in a closed configuration. In this figure it is possible to see some further possible construction details concerning the first sealing element 7 and its positioning in housing 86. From this figure one can also comprehend how said shutter can rotate about an axis of rotation "Y" defined by said pin 40.

This figure also shows some other construction details of axial hole 82, particularly near radial aperture 84, in the vicinity of which there is also said housing 86. From this figure it is possible, in fact, to see the widening of the diameter of axial hole 82, which is useful to allow shutter 4 to rotate.

Figure 5:
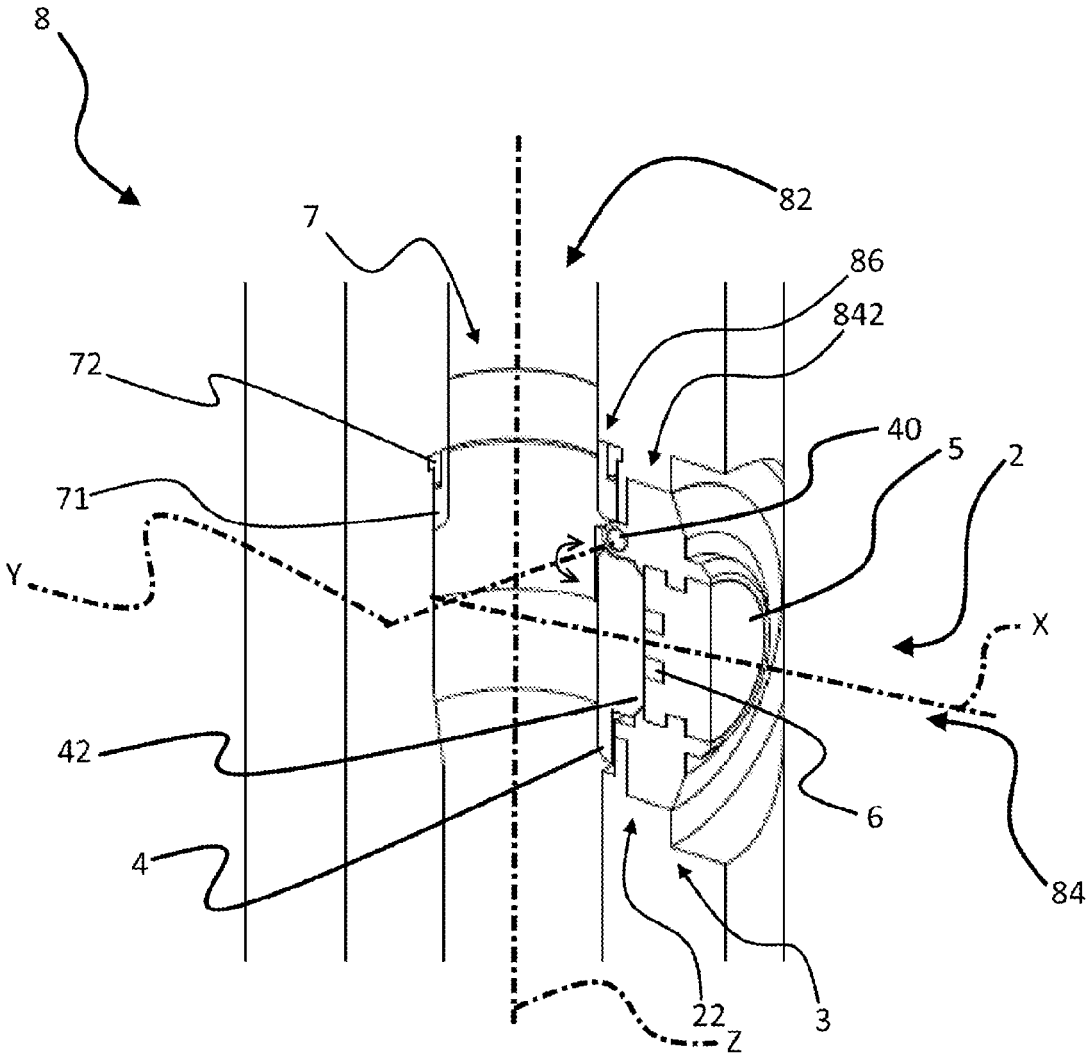
FIG. 5 shows a detail of the vertical sectional view of FIG. 4, illustrating in greater detail the valve element in the closed configuration.

In FIG. 5 one can see a detail of the vertical section of FIG. 4, which illustrates valve element 2 more clearly. In particular, in this figure one can see further details of gasket 71 and of elastic element 72 comprised in the first sealing element 7, as well as of housing 86 and of radial aperture 84 in which said threaded or shape-coupling portion 842 is formed to interact with said fixing portion 22 of valve element 2.

This figure also shows a preferred embodiment of shutter 4, with which said second sealing element 42 is integrated, the latter being so shaped as to ensure tightness against said first sealing element 7. In this figure one can also see the conformation of the portions of shutter 4 and of body 3 that permit hinging said shutter 4 to body 3 without exposing the hinging point to the flow of drilling mud in said axial hole 82.

In this figure one can also see a preferred embodiment of plug 5, which houses a return means 6, preferably of the magnetic type. From this figure it is also possible to understand how said plug 5 is fixed to said body 3 by shape coupling, in particular by means of a bayonet joint or the like.

FIG. 6 shows an exploded axonometric view of the assembly made up of valve element 2 and drilling element 8. In this figure one can see further construction details of drilling element 8, which comprises an axial hole 82 extending along said longitudinal axis "Z", a radial aperture 84, and junction portions 88. Through radial aperture 84 said housing 86 is partially visible. The figure also shows the various components that make up said valve element 2, i.e.: a discoid plug 5; an annular return means 6; body 3 defining said inlet aperture 3A and said outlet aperture 3B joined by said duct 31. On the perimetric lateral surface of body 3 said fixing portion 22 is formed. In this figure one can also see shutter 4, substantially discoid in shape, which in turn comprises said second sealing element 42. Shutter 4 can be hinged to body 3 through pin 40. Finally, FIG. 6 shows an embodiment of the first sealing element 7 comprising a gasket 71 and an elastic means 72, both annular in shape.

From FIG. 6 a person skilled in the art will unmistakably comprehend that the number of parts and elements necessary for making a valve element 2 according to the present invention is extremely small, while still ensuring high levels of reliability.

Figure 7:
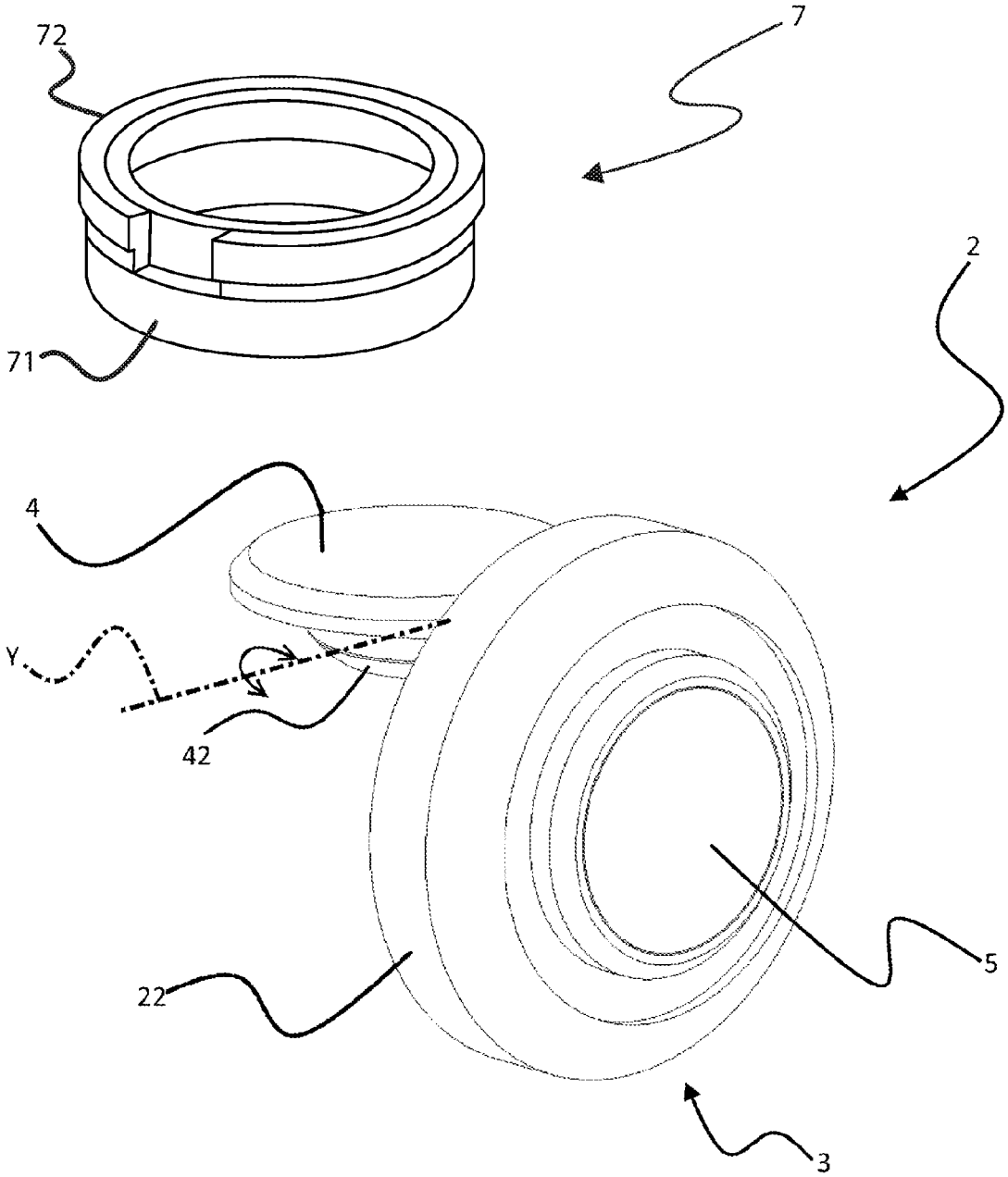
FIG. 7 shows an axonometric view of the single valve element according to the present invention.

FIG. 7 shows an axonometric view of valve element 2 according to the present invention. From this figure one can understand the relative arrangement of said body 3, said plug 5 and said shutter 4. The figure also shows the coupling between gasket 71 and elastic means 72 that constitute said first sealing element 7.

FIG. 8 shows a drilling element 8 in a sectional view relative to a vertical plane. From this figure one can understand the conformation of axial hole 82, of housing 86 and of junction portions 88. Besides, this figure also shows the conformation of radial aperture 84, which is adapted to house said body 3 of valve element 2, and the conformation of axial hole 82 in proximity to radial aperture 84 and of housing 86 proximal to said radial aperture 84. In this figure one can see the conformation of the threaded or shape-coupling portion 842 formed in the walls of radial aperture 84, adapted to be coupled to fixing portion 22 of valve element 2.

Valve element 2 according to the present invention can be easily assembled to a drilling element 8.

Valve element 2 according to the present invention ensures higher operational efficiency as far as maintenance times are concerned.

Valve element 2 according to the present invention is less subject to wear of its components, since the latter are incorporated into the structure of drilling element 8 and are less exposed beyond the walls defined by drilling element 8.

The present invention makes it possible to further reduce the effect of wear due to a reduced number of components necessary for the proper operation of valve element 2, and more particularly because said shutter 4 is pivoted to body 3 and adapted to rotate about an axis of rotation "Y" perpendicular to both said longitudinal axis "Z" and said first axis "X", located in proximity to said radial aperture 84.

The present invention makes it possible to carry out maintenance and/or repairs in case of failures of valve element 2, e.g. on said shutter 4 and/or on said first sealing element 7, by working from radial aperture 84 of drilling element 8 with which said valve element 2 is associated.

Therefore, the present invention makes it possible to considerably reduce the downtime of the drilling rig, thereby increasing profit.

The present invention makes it possible to produce a reliable and safe valve element 2 with a reduced number of components, with no elements suspended or free to move inside drilling element 8, thus eliminating those critical elements which are typically employed in prior-art solutions.

The present invention makes it possible to produce a valve element 2 which has an average service life in excess of 750 hours, e.g. because the vibration of the axial seal during the drilling process is considerably reduced in comparison with prior-art solutions. This solution makes it possible to further reduce the downtime of the drilling rig.

The present invention makes it possible to install said valve element 2 on any drilling element 8, even a drill pipe, and even in a central portion thereof, i.e. distant from the its junction portions 88.

Moreover, since said valve elements 2 can be installed directly on drill pipes, when assembling strings of the types commonly defined as range-2 or range-3 this solution reduces the discontinuities in the string lowered in the well, because it is no longer necessary to add further elements such as, for example, subs. As a result, this solution reduces the risk of failures that may cause the undesired effect known as washout.

Valve element 2 according to the present invention may, for example, be assembled to the box of the tool joint of the drill pipe, leading to evident advantages in terms of safety and operability. Furthermore, valve element 2 according to the present invention may also be assembled to a sub, offering all of the above-illustrated advantages in comparison with the existing technical solutions.

The present invention ensures that inside the drilling elements there is a minimum inner passage section of 2"¾ (70.1 mm). The present invention reduces load losses, thus improving the performance of the drilling rig, in addition to allowing the passage of retrieval devices that need to be lowered along the axial hole of the drilling elements, also known as fishing tools.

Moreover, in the present invention the internal sealing elements, in particular said first sealing element 7, are not directly hit by the flow of drilling mud, thus improving those aspects which are related to load losses, as previously mentioned, and ensuring a longer service life of valve element 2.

In summary, valve element 2 has a longer service life because it is not subject to heavy wear phenomena and, should any maintenance of valve element 2 be required, such task can be carried out quickly through radial aperture 84 of drilling element 8, even without having to remove from the string of drill pipes drilling element 8 with which said valve element 2 is associated. In addition, valve element 2 suffers much smaller load losses than the valve elements known in the art, since it can be integrated into a drill pipe, thus avoiding a point of discontinuity that would be created by a sub.

The present invention permits making drilling elements 8, in particular subs, which are shorter but nonetheless re-threadable.

The present invention permits making drilling elements characterized by any type of threaded connection, in particular high-performance double-shoulder connections.

In some cases, the present invention makes it possible to apply valve elements 2 to existing drilling elements 8 designed for other types of valve elements.

The present invention can be easily applied to any boring or drilling technology, e.g. even wired drill pipe technologies, allowing for instantaneous and bidirectional transmission of the well bottom data both during the boring or drilling and during the drill pipe change phase.

Any embodiments which have not been described herein, but which can be easily inferred by a person skilled in the art in light of the present description and the annexed drawings, shall be considered to fall within the protection scope of the present invention.

| REFERENCE NUMERALS: | |
|---|---|
| Valve element | 2 |
| Fixing portion | 22 |
| Body | 3 |
| Inlet aperture | 3A |
| Outlet aperture | 3B |
| Duct | 31 |
| Shutter | 4 |
| Pin | 40 |
| Second sealing element | 42 |
| Plug | 5 |
| Return means | 6 |
| First sealing element | 7 |
| Gasket | 71 |
| Elastic means | 72 |
| Drilling element | 8 |
| Axial hole | 82 |
| Radial aperture | 84 |
| Threaded or shape-coupling portion | 842 |
| Housing | 86 |
| Junction portions | 88 |
| First axis | "X" |
| Axis of rotation | "Y" |
| Longitudinal axis | "Z" |

The invention claimed is:

1. A valve element for selectively opening and closing both a radial aperture and an axial hole in a drilling element for drilling mud circulation; said valve element comprising:

a fixing portion adapted to sealingly fix the valve element to walls of a hole defining said radial aperture of the drilling element;

a body comprising an inlet aperture and an outlet aperture, and a duct for putting said inlet aperture and said outlet aperture in communication with each other, defining a path for the drilling mud;

a plug adapted to be fixed to said body to selectively seal said inlet aperture of the body;

a first sealing element, adapted to be positioned in a housing formed in the axial hole of the drilling element;

a single shutter, pivoted to the body and comprising a second sealing element adapted to selectively and sealingly close said outlet aperture of the body; said shutter being adapted to selectively and sealingly close said axial hole by abutting against said first sealing element;

said shutter being adapted to keep said outlet aperture of the body normally closed.

2. The valve element according to claim 1, wherein said body defines an outer portion whereon said fixing portion is formed, so that said body does not protrude past the walls of said drilling element.

3. The valve element according to claim 1, wherein said plug is fully removable from said body.

4. The valve element according to claim 1, wherein said shutter comprises at least one ferromagnetic portion; said valve element comprising a magnetic return adapted to keep said shutter in sealed abutment with said outlet aperture of the body to keep said single shutter closed against said outlet aperture under a load pressure.

5. The valve element according to claim 1, wherein said first sealing element comprises:

a gasket adapted to abut on said shutter to sealingly close said axial hole;

an elastic element adapted to keep said gasket in position within said housing.

6. The valve element according to claim 1, wherein said plug is automatically removable.

7. The valve element according to claim 1, wherein said body has a discoid shape and said fixing portion is formed as a threaded or shape-coupling portion adapted to sealingly match a threaded or shape-coupled portion formed in the walls of the hole defining said radial aperture.

8. The valve element according to claim 1, wherein said shutter is a flap valve.

9. The valve element according to claim 1, wherein said shutter rotates about an axis of rotation perpendicular to a first axis along which said duct extends; said axis of rotation being perpendicular to a longitudinal axis of an axial hole of the drilling element.

10. A drilling element having a substantially cylindrical shape, adapted to allow continuous circulation, comprising:

an axial hole;

at least one radial aperture; and junction portions, located at ends of the drilling element; wherein a valve element according to claim 1 is associated with the radial aperture.

11. The drilling element according to claim 10, wherein said radial aperture is located either in a central region of the drilling element, distant from said junction portions, or in proximity to a junction portion.

12. The drilling element according to claim 10, wherein said drilling element is:

a drill pipe, comprising a junction element or portion, or box, of the tool joint of the drill pipe; or a coupling element, or SUB.

13. A method for assembling a valve element according to claim 1 to a drilling element, having a substantially cylindrical shape, adapted to allow continuous circulation, the drilling element comprising:

an axial hole;

at least one radial aperture; and junction portions, located at ends of the drilling element; wherein the valve element is associated with the radial aperture;

the method comprising the following steps:

providing the valve element and the drilling element;

associating the first sealing element with the housing formed in the axial hole of the drilling element;

fixing the body to the radial aperture of the drilling element.

14. The method according to claim 13, wherein the step of associating the first sealing element is carried out by passing said sealing element through the radial aperture of the drilling element.

15. The method according to claim 13, wherein the step of fixing the body to the radial aperture is carried out by screwing said body.

16. A valve element for selectively opening and closing both a radial aperture and an axial hole in a drilling element for drilling mud circulation; said valve element comprising:

a fixing portion adapted to sealingly fix the valve element to walls of a hole defining said radial aperture of the drilling element;

a body comprising an inlet aperture and an outlet aperture, and a duct for putting said inlet aperture and said outlet aperture in communication with each other, defining a path for the drilling mud;

a plug adapted to be fixed to said body to selectively seal said inlet aperture of the body;

a first sealing element adapted to be positioned in a housing formed in the axial hole of the drilling element;

a single shutter pivoted to the body and comprising a second sealing element adapted to selectively and sealingly close said outlet aperture of the body; said shutter being adapted to selectively and sealingly close said axial hole by abutting against said first sealing element;

said shutter being adapted to keep said outlet aperture of the body normally closed;

when said valve element is associated with radial aperture of the drilling element and said valve element is in a closed configuration, said single shutter protrudes no further than a minimum diameter of said axial hole.

* * * * *